United States Patent [19]

Bailey

[11] Patent Number: 5,024,337

[45] Date of Patent: Jun. 18, 1991

[54] BAND AND LABEL CARRIER

[76] Inventor: Larry D. Bailey, 167 E. Pine Ave., Mobile, Ala. 36572

[21] Appl. No.: 375,276

[22] Filed: Jul. 3, 1989

[51] Int. Cl.[5] ..... A47F 5/08

[52] U.S. Cl. ..... 211/88; 248/214

[58] Field of Search ..... 248/214, 215, 311.2, 248/314, 211, 210; 221/92, 130; 211/88, 71

[56] References Cited

U.S. PATENT DOCUMENTS

| | | | |
|---|---|---|---|
| 686,289 | 11/1901 | Grove | 221/283 X |
| 1,521,958 | 1/1925 | Lewis | 221/92 X |
| 2,043,560 | 6/1936 | Savage | 221/185 X |
| 2,295,313 | 9/1942 | Weir | 221/92 X |
| 2,451,382 | 10/1948 | Davis | 221/186 X |
| 2,635,797 | 4/1953 | Siebert | 248/211 X |
| 2,706,066 | 4/1955 | Wells | 221/92 |
| 3,642,240 | 2/1972 | Hershey | 248/311.2 X |
| 3,757,380 | 9/1973 | Jackson | 248/211 X |
| 3,986,649 | 10/1976 | Heimstra | 211/88 X |
| 4,475,660 | 10/1984 | Cain | 211/88 X |
| 4,538,727 | 9/1985 | Solloway | 248/212 X |
| 4,805,864 | 2/1989 | Votta | 248/311.2 |

*Primary Examiner*—David M. Purol

[57] ABSTRACT

A sensitive sticker and rubberband dispenser designed to hange or to rest upright on a level surface having a chamber divided for holding rubberbands in an upper chamber and boxes of sensitive stickers in a bottom chamber, the bottom chamber having an two openings, one for communicating outside of the front of the chamber through which the sensitive stickers feed and the second for loading boxes of sensitive stickers.

8 Claims, 3 Drawing Sheets

BAND AND LABEL CARRIER

DISCUSSION OF THE PRIOR ART

1. Field of Invention

The invention relates to label dispensers supported on brackets. More particularly, the invention relates to a multichambered label dispenser used in the distribution of rubberbands and rolls of sensitive stickers or stamps from boxes.

2. Pertinent Prior Art

In mail distribution at the present time, the postal system utilizes a stamp system comprising five to ten boxes of rolls of stamps or stickers (referred to as "sensitive stickers") on waxed sheets which are used to mark bundles which are held together by rubberbands. This has been a relatively slow and bulky process due to a lack of a holder for the boxes of rolls of stickers and rubberbands; particularly, since the mail sorter must push a basket or dolly while holding on to boxed rolls of commonly used stickers and rubberbands.

In mail distribution, the use of a mail carrier with a handle or hanger with a hook portion is old in the art, see Savage, U.S. Pat. No. 2,043,560. Similarly the use of slots for holding and dispensing labels is known generally in the prior art shown in U.S. Pat. No. 686,289 (Grove) and U.S. Pat. No. 4,750,640 (Kobeck).

Also shown in the prior art are vertical and horizontal dispensing mechanisms as shown by Shanks, U.S. Pat. No. 1,019,093 and Oldorf U.S. Pat. No. 4,767,022 respectively. The Shanks patent also shows a rear-loading dispenser (generally in the art of dispensing mechanisms).

Similar non-partitioned paper holders are shown in Ehrlich, U.S. Pat. No. 888,072; Davis, U.S. Pat. No. 2,451,382; Gasparini, U.S. Pat. No. 2,914,216; and Babson, U.S. Pat. No. 1,764,673. The present invention relates specifically to a stamp and label dispenser designed for easy loading and dispensing of sensitive stickers which may rest on a level surface, such as a table and attach to a cart having a bar for distribution of stickers which are independently housed in their own boxes.

In connection therewith it should be noted that the labels that are dispensed come in dispensing boxes which the present invention, hereinafter sometimes referred to as the stamp and label dispensing box is designed to hold.

SUMMARY OF THE INVENTIONS

Because several of these different labels are used by the postal processing individual at a time, the stamp and label dispensing is designed to hold boxes of labels and distribute the same in an orderly and neat fashion along with rubberbands which group bundles of mail which are marked with the labels distributed. The box is designed for simplicity of manufacture, in holding labels and receiving labels as well as distribution of stamps. It is made to be used with the existing dollys and is removably attachable to said dolly by way of hangers with hooks.

The patent improves over the prior art by giving easy access to a top chamber for holding rubber bands, providing a a lower chamber which securly holds between 3 full walls and two partial walls boxes of different size stickers and by allowing easy removal and placement on level surfaces for reloading boxes or storage.

Therefore the primary objects of this invention are to provide a label holder and dispenser for use with the cart which serves to hold and easily receive boxes of prepackaged labels of varying sizes and to dispense those labels individually while providing the user with easy access to rubberbands for bundling mail together.

The further object of the invention is to provide for such a label holder which is easily added to a cart or removed from a cart or dolly such as used in the mall art. A further purpose of the invention is to provide a label dispenser of the type shown which utilizes a minimum number of parts for ease of construction and economy of construction.

These and other objects of the invention may be more readily observed from the accompanying drawings and detailed description given below.

BRIEF DESCRIPTION OF THE DRAWINGS

In the accompanying drawings the preferred embodiment is illustrated in which the same reference numerals designate the same parts and all for use.

DETAILED DESCRIPTION OF THE PREFERRED EMBODIMENT

Figure 1:
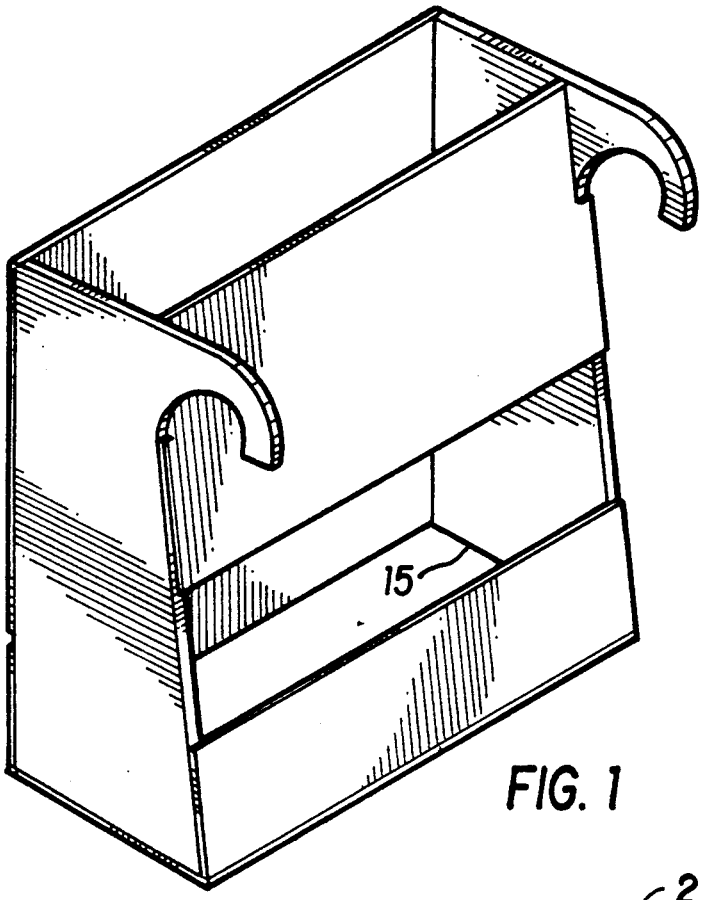
FIG. 1 is a perspective view of the invention viewed from the back.

FIG. 1 shows the assembled Balley Box as it would appear when the stamp and label dispensing box is ready to mount on a cart or dolly. The invention comprises a left side 1 having a hanger 13, a right side 2 having a hanger 14, connected along their lower end 15 by floor 3 and at the rear of sides 1 and 2 by upper backing 5 and lower backing 4 and the front of sides 1 and 2 by upper facing 7 and lower facing 6. Barely visible from this angle is divider shelf 8 which serves to separate the inside of the box so formed into an upper compartment 11 and a lower compartment 10.

Figure 2:
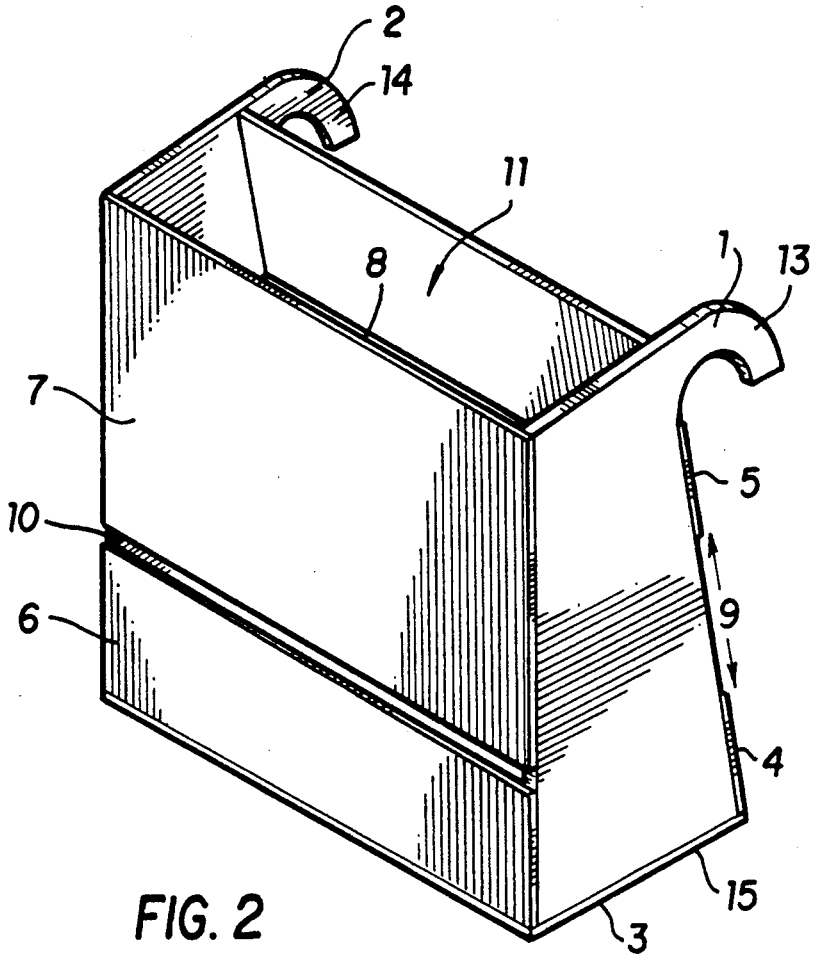
FIG. 2 is a perspective view of the invention from the front.
Figure 3:
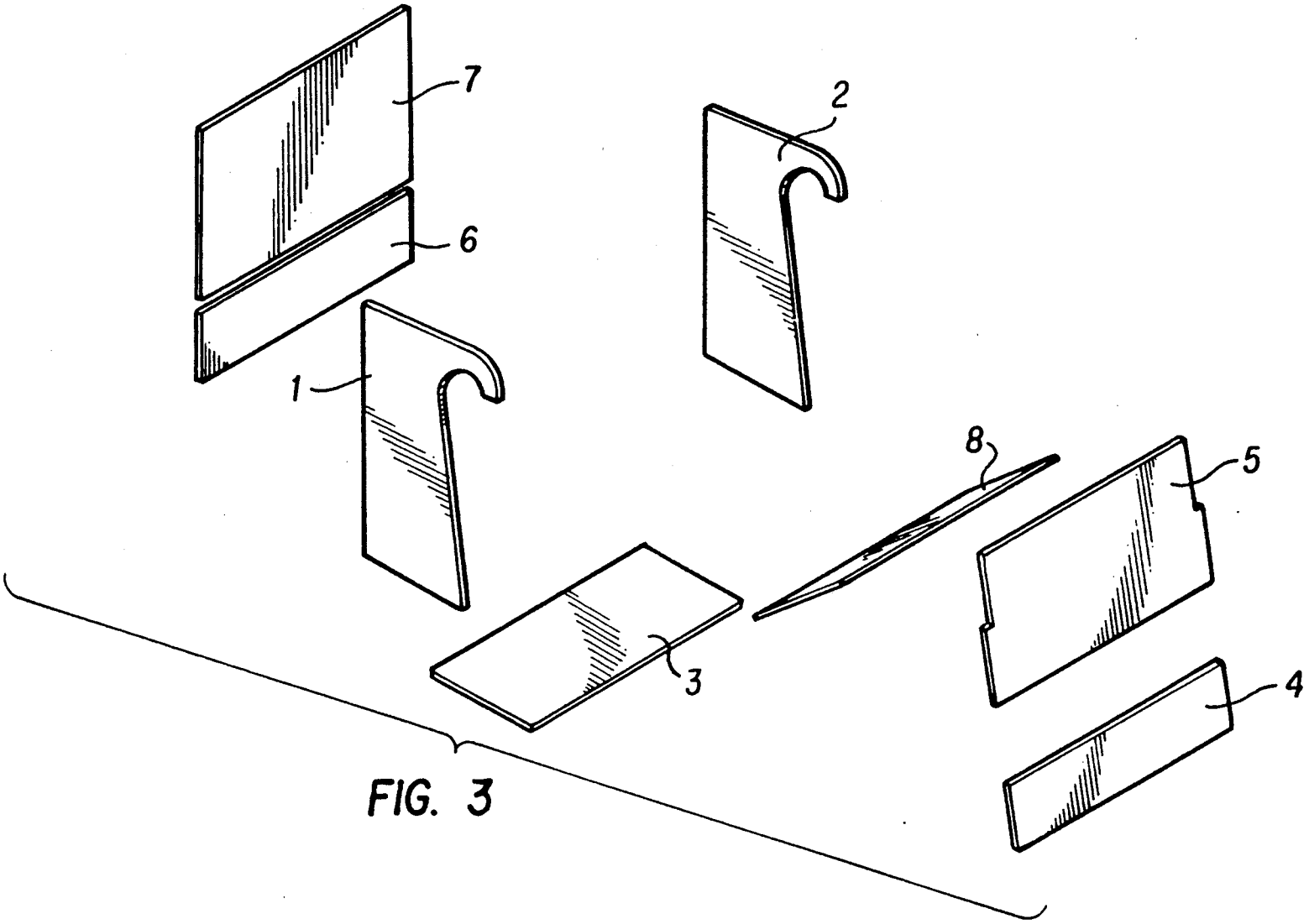
FIG. 3 is a exploded view of the invention shown in FIGS. 1 and 2 showing the component parts.
Figure 4:
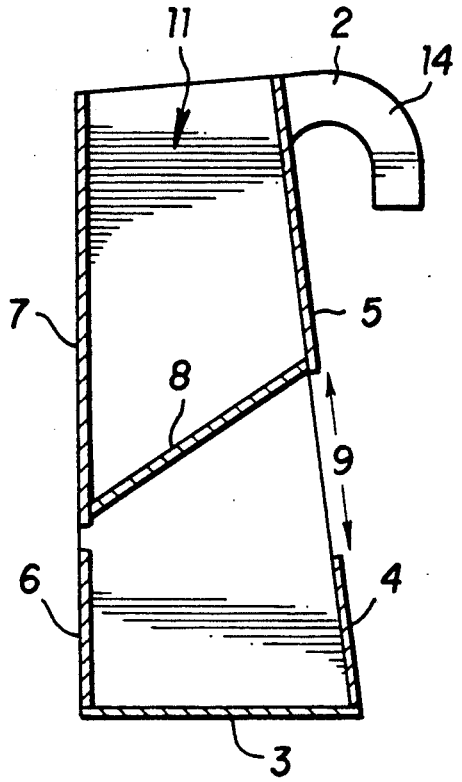
FIG. 4 is a cross-sectional view of the invention along the vertical axis.

As best seen by reference to FIG. 2, there is an opening 9 in the rear defined by the bottom of upper backing 5 and the tip of lower backing 4 by the left side 1 and the right side 2. The size of this back opening 9 is sufficient in order to allow the easy insertion and removal of sticker cartons or label dispensing boxes, (not shown), which are inserted through the back opening 9 so as to be held in a row in the lower chamber 10. The length of the lower chamber from the front to the back of the Bailey Box is at least as long as a box of labels. The width of the lower chamber defined as the distance between the left side 1 and the right side 2 is from twelve-fourteen inches in order to allow extra space from extra boxes of commonly used stickers. The boxes of labels or stickers held are usually one (1) to one-point-two-five (1.25) inches and vary depending on the size of labels. Usually the boxes are one inch by three inches by three inches so that the distance between lower facing 2 and lower backing 7 is slightly over three inches. A smaller opening defined as a front slot 12 is defined by the top of the lower facing 6 and the bottom of the upper facing 7. This front slot 12 is approximately 0.25 to 0.5 inchs high and is the entire length of the front so that the strips of labels may feed out of the front slot.

The upper chamber 11 is defined by a divider shelf 8 which serves to separate the upper chamber 11 from the lower chamber 10. This divider shelf 8 slants from the bottom of the upper backing forward to the bottom of the upper facing. The purpose of this design is to provide that the maximum number of rubberbands can be held in the upper chamber 11. The width of the left side 1 and right side 2 is greater at the bottom than at the top of sides 1 and 2. The reason for this difference is to allow when the hangers 13 and 14 are hung on the top bar of a dolly, the center of gravity of the stamp and label dispening box. Is shifted to the rear and the stamp and label dispensing box leans back closing off the back opening 9 while holding the box firmly to the dolly. In order to assist this function, the front of the stamp and label dispensing box may be weighted along the lower intersection of the lower facing 6 and bottom 3. This is not necessary when the box is made out of wood or plastic but if lighter material such as paper or cardboard were used for the manufacturing of the box, then this weighting would be desirable in order to hold the stamp and label dispensing box more firmly along the upper backing 5 and lower backing 4 to the dolly which it is mounted.

The bottom 3 of the stamp and label dispensing box is flat so that it might be placed on a table if there is no convenient place to hang it when it is not in use or when it is being loaded with boxes of labels.

The greater width of the bottom 3 also provides for the stamp and label dispensing box to have a low center of gravity when it is resting on a table.

The hangers 13 and 14 are made to curve only partway because a canvas cover on the dolly prevents the hangers from curving all the way over the bar on the dolly. The distance between the bottom 8 of the stamp and label dispensing box and the lower side of the hangers 13 and 14 is equivalent to the length between the first bar of the dolly and the second lower bar of the dolly on which the invention hangs.

The height of the lower facing is defined by the height of the boxes of stickers or labels which fit in the stamp and label dispensing box and is, therefore, at least three inches high.

The upper facing 7 and the upper backing 5 provide convenient locations for the name of the user of this particular box so as to prevent confusion.

The invention functions by having the user set the invention on the table while the sensitive stickers, held in boxes, are inserted into the lower chamber 10 through the back opening 9 and arranged in a row. The lower backing 4 prevents from the labels from sliding out after they have been inserted and because the length of the stamp and label dispensing box is only slightly greater than the length of the boxes of labels, the boxes do not get turned. Once the boxes of labels are inserted, they serve to keep each other facing forward. There is sufficient height from the bottom of the upper backing 5 to the top of the lower backing 4 to allow the user to then insert his hands inside the back opening 9 and the into the lower chamber 10 in order to feed the labels out through front slot 12. The front slot 12 is sufficiently narrow so that when the labels are pulled through, the boxes are prevented from coming through and the labels are also prevented from feeding through at a greater rate than might be possible if the slot 12 were larger.

After the insertion of the sensitive stickers in their boxes, rubberbands are placed in the upper chamber 11 which is of maximum volume to the size of the stamp and label dispensing box and has a sufficient opening at the top to allow the user to insert his hands in the upper chamber 2 to remove rubberbands. The entire height of the front of the stamp and label dispensing box is approximately twelve and three-eights inches, with the lower facing 6 being approximately three and one-eights inches, the front slot 12 being approximately one-half inch and the upper facing 7 being approximately eight and one-half inches high.

The length of the upper chamber 10 is approximately three and seven-eights inches. It is approximately six and five-sixteenth's inches from the top of the upper backing 5 to the bottom of the upper backing 5. There is then an opening of approximately three and thirteen-sixteenths inches in the back opening 9 and the lower backing 4 is approximately three and one-eights inch high. The length of the bottom 3 is approximately five and three-eights inches.

The dispenser may have a flexible covering over the space defined by upper facing 7 and lower facing 6, attached to upper facing 7 and which is biased to cover the space and flexibly contact the lower facing 6 along that facing to prevent labels from feeding at an excessive rate.

After the boxes of stickers are loaded into the stamp and label dispensing box, it is then lifted from the table and hooked on to the dolly by way of the hangers 13 and 14 on the left side 1 and right side 2. The weight distribution of the device then makes it lean backwards into the canvas of the dolly and the labels and rubberbands are available for use.

What I claim is:

1. A rubberband and sensitive sticker dispenser for use with a dolly having bars or a level surface comprising:

(a) A bottom having a front and rear;

(b) A left side having a front and rear and a top and a bottom, the top defining a hanger member at the rear;

(c) A right side member having a front and rear and a top and a bottom with the top defining a hanger member at the rear so that both hanger members allow for mounting the device on the dolly bars attached along its lower end to the bottom at the side opposite the left side;

(d) An upper facing attached to the front of the left side and right side members opposite the hangers;

(e) A lower facing attached to to the front of the left side and right side opposite the hangers and contacting the front of the bottom so that the upper facing and lower facing define a space between the top of said lower facing and the bottom of the upper facing;

(f) An upper backing attached to the rear of the left and right side directly below the hangers and extending downward attached to the rear of the left and right sides;

(g) A lower backing attached to the rear right side and left side below the upper backing so as to define a back opening and attached to the bottom at the rear of the left and right side;

(h) A divider shelf extending between the upper facing and the upper backing above the back opening so as to separate the interior of the container so formed into an upper chamber and lower chamber.

2. The dispenser of claim one wherein the front of the lower facing is weighted so as to shift the center of gravity of the dispenser forward when the dispenser is hanging by the hangers.

3. The dispenser of claim one wherein the divider shelf extends from the bottom of the upper backing along the length of the upper backing down to the bottom of the upper facing along the length of the upper facing.

4. The dispenser of claim one wherein the bottom is essentially flat so that the device will sit upright on the bottom when the device is placed on a level surface.

5. The dispenser of claim one wherein the space defined by the lower facing and upper facing is less than one half inch.

6. The dispenser of claim one wherein there is a flexible covering over the space which is biased to cover the space and flexibly contact the lower facing to prevent stamps from feeding at an excessive rate.

7. A rubberband and sensitive sticker dispenser for distribution of sensitive stickers from boxes comprising:

(a) A bottom being longer than as one of the boxes;

(b) A left side having a front, a rear, a bottom and a top which top defines a hanger member said left side being attached along its bottom to the bottom;

(c) A right side having a front, a rear bottom and a top which top defines a hanger said right side member being attached along its lower end to the bottom opposite the attachment of the left side;

(d) A facing defining a space attached to the front of the left side and right side;

(e) A lower facing attached to either end to the left side and right side opposite the hangers and contacting the bottom defining a space between the top of said lower facing and the bottom of the upper facing so that when joined the upper and lower facings and bottom tend to hold the boxes within the chamber defined thereby and prevent the boxes from falling out;

(f) An upper backing attached to the back of the left and right side directly in front of the hangers and extending downward along the back of the left and right sides on either side;

(g) A lower backing defining a back opening and attached to the rear of the left and right side;

(h) A divider shelf extending between the facing and backing so as to separate the interior of the container so formed into an upper chamber and lower chamber.

8. The invention of claim 7 wherein the distance between the upper facing and lower facing is smaller than the height of the boxes.

* * * * *